US010154743B1

(12) United States Patent
Ferguson

(10) Patent No.: US 10,154,743 B1
(45) Date of Patent: Dec. 18, 2018

(54) SPLIT BLANKET

(71) Applicant: Shelley Rae Ferguson, Middleton, WI (US)

(72) Inventor: Shelley Rae Ferguson, Middleton, WI (US)

( * ) Notice: Subject to any disclaimer, the term of this patent is extended or adjusted under 35 U.S.C. 154(b) by 0 days.

(21) Appl. No.: 15/785,633

(22) Filed: Oct. 17, 2017

Related U.S. Application Data

(60) Provisional application No. 62/410,446, filed on Oct. 20, 2016.

(51) Int. Cl.
*A47G 9/04* (2006.01)
*A47G 9/02* (2006.01)

(52) U.S. Cl.
CPC ..... *A47G 9/04* (2013.01); *A47G 9/0223* (2013.01); *A47G 9/023* (2013.01)

(58) Field of Classification Search
CPC ..... A47G 9/02; A47G 9/0207; A47G 9/0223; A47G 9/023; A47G 9/0238; A47G 9/04; Y10T 24/3647; Y10T 24/3677; A44B 1/02; A44B 1/08; A44B 1/12
USPC ..... 5/486, 482, 496, 495, 502; 24/114.1, 24/102 P
See application file for complete search history.

(56) References Cited

U.S. PATENT DOCUMENTS 1,748,098 A * 2/1930 Alstrand ..... A41F 1/00 24/102 P
2,336,192 A * 12/1943 Rouse ..... A44B 1/12 2/244
2,689,961 A * 9/1954 Lieberthal ..... A47G 9/023 5/486
2,730,728 A * 1/1956 Roberts ..... A47G 9/023 5/486
3,072,776 A * 1/1963 Quenneville ..... H05B 3/342 219/212
3,512,225 A * 5/1970 Halstead ..... A44B 13/00 24/381
4,573,227 A * 3/1986 Prandina ..... A47G 9/0207 5/486
5,943,717 A * 8/1999 Alexander ..... A47G 9/023 5/482
6,226,814 B1 * 5/2001 Alexander ..... A47G 9/023 5/486
6,311,347 B1 * 11/2001 Limardi ..... A47G 9/0223 5/482
6,643,871 B1 11/2003 Robke
(Continued)

OTHER PUBLICATIONS

Website: DoubleUps for Beds, downloaded from https://www.doubleupsforbeds.com/our-story/ on Oct. 16, 2017.

*Primary Examiner* — Robert G Santos
(74) *Attorney, Agent, or Firm* — Craig A. Fieschko, Esq.; DeWill Ross & Stevens S.C.

(57) ABSTRACT

The invention is a blanket for allowing multiple users different coverage from the same blanket. A slit extends from the top of the blanket toward the blanket's bottom and along at least a substantial portion of the blanket's length. The slit is situated inwardly from the sides of the blanket, defining blanket sections separated by the slit. At least one fastener provided on one or both sides of the slit allows the blanket sections on opposing sides of the slit to be removably attached together at desired locations. By detaching the blanket sections, one user may raise or lower their blanket section as they wish without requiring another user to do the same.

20 Claims, 3 Drawing Sheets

(56) References Cited

U.S. PATENT DOCUMENTS

| | | | | |
|---|---|---|---|---|
| 6,698,043 | B2 * | 3/2004 | Fabian | A47G 9/0238 5/482 |
| 6,862,760 | B2 * | 3/2005 | Bradley | A47G 9/023 24/72.5 |
| D684,797 | S * | 6/2013 | Rohwer | D6/603 |
| 2003/0121100 | A1 * | 7/2003 | Fabian | A47G 9/0238 5/486 |
| 2003/0217411 | A1 * | 11/2003 | Bradley | A47G 9/023 5/486 |
| 2013/0014326 | A1 * | 1/2013 | Kane | A47G 9/02 5/482 |

* cited by examiner

SPLIT BLANKET

CROSS-REFERENCE TO RELATED APPLICATIONS

This application claims priority under 35 USC § 119(e) to U.S. Provisional Patent Application 62/410,446 filed 20 Oct. 2016, the entirety of which is incorporated by reference herein.

FIELD OF THE INVENTION

This document concerns an invention relating generally to bedding and coverings, and more specifically to blankets particularly designed for use by couples.

BACKGROUND OF THE INVENTION

Couples often share a blanket when sleeping or sitting next to each other. When doing so, the blanket users may have different preferences for their individual degree of blanket coverage: one user might only want his or her feet covered, whereas the other user may want to be covered up to his or her neck. If one user is a restless sleeper, they may pull on the blanket, disturbing the other's rest or pulling the blanket off the other sleeper. Sharing may therefore require compromise, and discomfort to one or both users, who may each have more or less coverage than desired. Alternatively, one or both parties may opt out of sharing and simply use his or her own blanket, resulting in loss of closeness and intimacy.

SUMMARY OF THE INVENTION

The invention seeks to provide an improved blanket which is intended to alleviate the difficulties experienced by multiple users of the same blanket by allowing selective detachment of different sections of the blanket.

A preferred version of the invention includes a slit extending from the top of the blanket toward its bottom and along at least a substantial portion of the blanket's length. The slit is situated inwardly from the sides of the blanket, providing multiple blanket sections separated by the slit. At least one fastener provided on one or both sides of the slit allows the blanket sections on the opposing sides of the slit to be removably attached together at desired locations. When the blanket sections are detached along at least a portion of the blanket's length, one user may raise or lower their blanket section about their body as they wish without requiring an adjacent user to do the same. One version of the invention uses a flexible fabric T-shaped button and eyehole as the fastener, allowing for easy attachment and detachment without using a hard fastener, which might cause discomfort if felt by a user.

BRIEF DESCRIPTION OF DRAWINGS

Versions of the invention will be discussed with reference to the accompanying drawings wherein:

FIG. 2*a* is a partial plan view of a first configuration of the preferred version of the invention, while

FIG. 3*a* is a partial perspective view of the first configuration of the preferred version of the invention, while

In the following description, like reference characters designate like or corresponding parts throughout the figures.

DETAILED DESCRIPTION OF EXEMPLARY VERSIONS OF THE INVENTION

Figure 1:
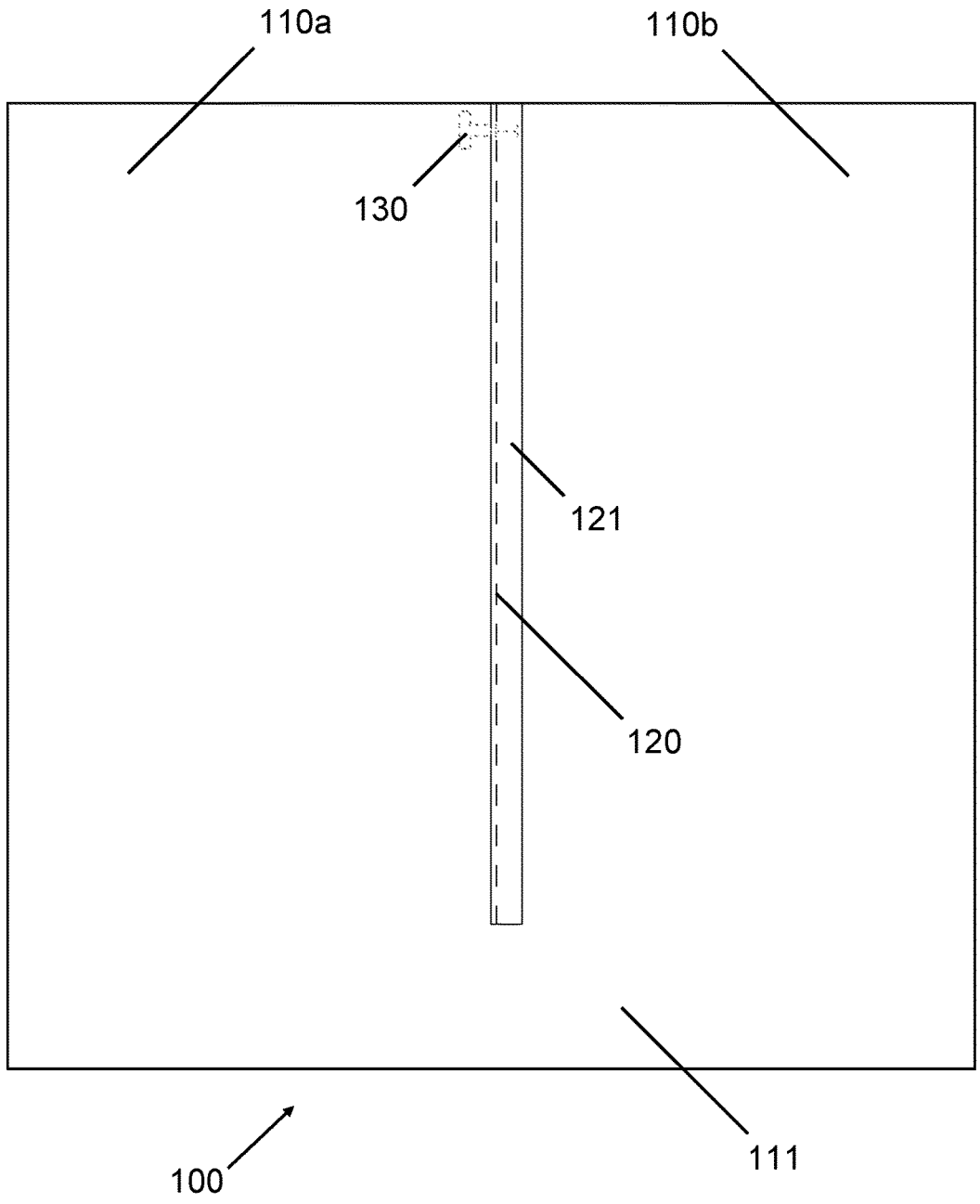
FIG. 1 is a top plan view of a preferred version of the invention.
Figure 2A:
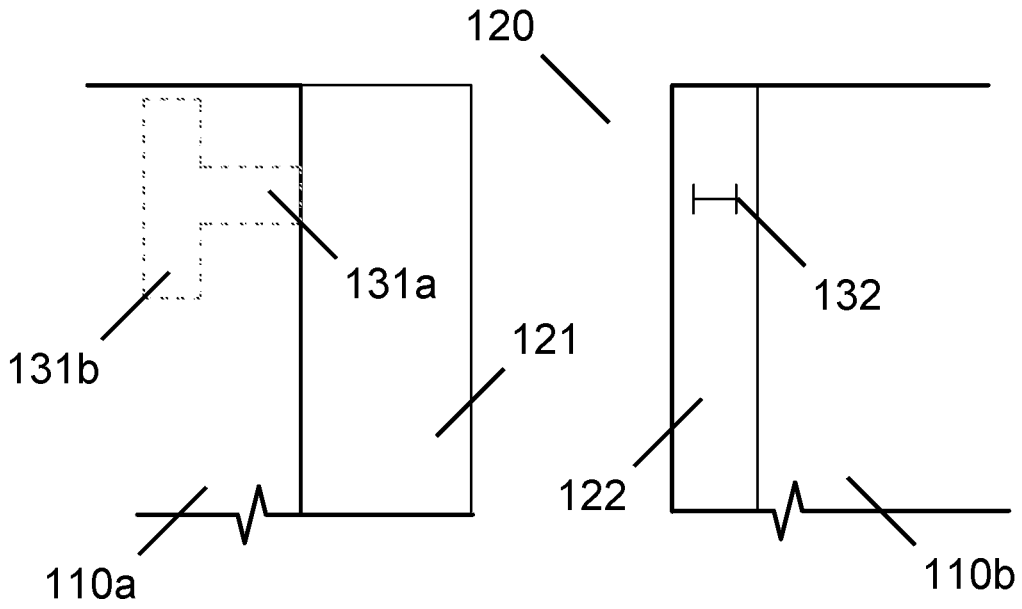
Figure 2B:
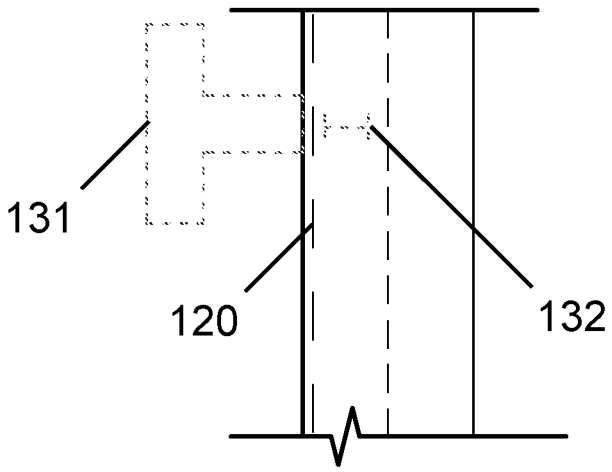
FIG. 2*b* is a partial plan view of a second configuration of the preferred version of the invention.
Figure 3B:
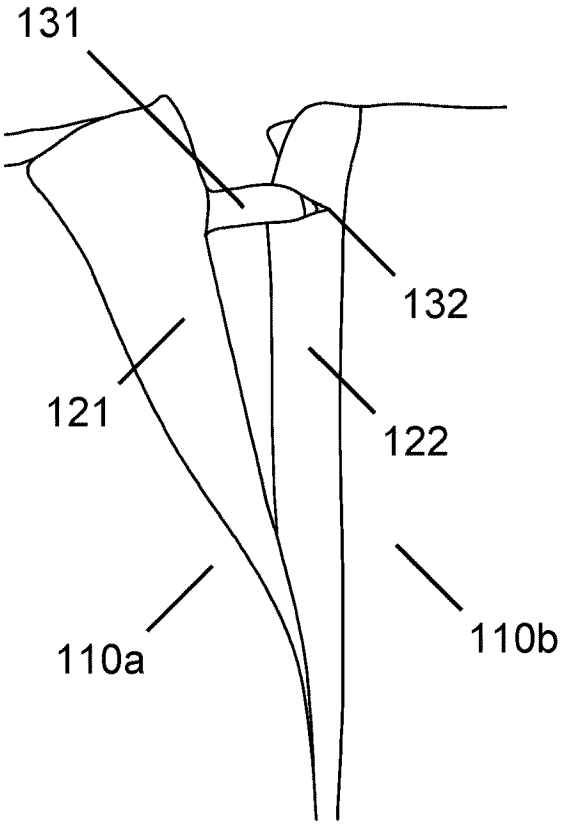
FIG. 3*b* is a partial perspective view of the second configuration of the preferred version of the invention.
Figure 3A:
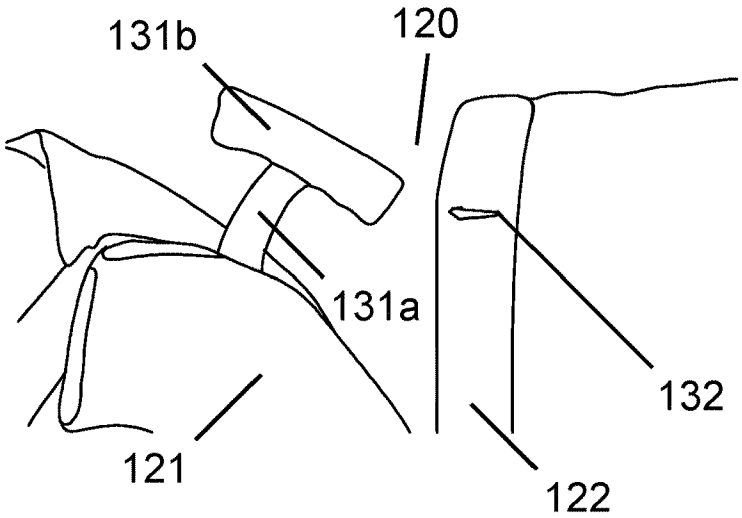

A preferred version of blanket 100, as best seen in the accompanying FIG. 1, involves blanket 100 having at least two blanket sections, first and second blanket sections 110*a* and 110*b*, separated by a slit 120. Slit 120 extends from the top of blanket 100 toward the bottom of blanket 100, along at least a substantial portion of the length of blanket 100, and is situated inwardly from the sides of blanket 100. In the preferred version of blanket 100, slit 120 is located halfway across the blanket's width, resulting in blanket sections 110*a* and 110*b* having approximately the same width. Other versions may include multiple slits 120 and corresponding additional blanket sections 110 for increased versatility, particularly in larger-sized blankets. In the preferred version of blanket 100, the bottoms of blanket sections 110*a* and 110*b* attach at or are integrally connected to the top of a blanket base 111. Blanket base 111 extends the width of blanket 100; slit 120 ends at the top of blanket base 111. In other versions, slit 120 is formed down the entire length of blanket 100, extending from the top to the bottom of blanket 100; in this version, blanket 100 does not include blanket base 111.

At least one fastener 130 is provided on or connected to blanket sections 110*a* and/or 110*b*. Fastener 130 is attached to blanket section 110*a* or 110*b*, and may removably attach to the opposing blanket section 110*b* or 110*a*, so that blanket sections 110*a* and 110*b* may be removably attached together at desired locations. Blanket sections 110*a* and 110*b* therefore can have their inner edges detached for a desired distance from the top of blanket 100, and attached for a desired distance from the bottom of blanket 100. As a result, adjacent users beneath blanket 100—each beneath a blanket section 110*a* or 110*b* on the opposite sides of slit 120—can detach blanket sections 110*a* and 110*b* for a desired distance from the top of blanket 100 such that each user can cover him or herself with his or her blanket section 110*a* or 110*b* to a desired degree. Each user can therefore obtain his or her desired amount of coverage, while at the same time retaining the closeness and intimacy of a shared single blanket 100.

In the preferred version as seen in FIGS. 2*a* through 3*b*, a fabric overlay strip 121 is sewn, fused, or otherwise connected along the inner edge of blanket section 110*a* or 110*b*. Overlay strip 121 overlays the opposing blanket section when blanket sections 110*a* and 110*b* are fastened together, thereby helping to cover any gaps that may form between blanket sections 110*a* and 110*b* when blanket 100 is in use. The preferred version of blanket 100 also includes a fabric underlay strip 122 sewn, fused, or otherwise connected along the inner edge of blanket section 110*a* or 110*b*, whichever does not have overlay strip 121, to underlie overlay strip 121. In the preferred version, underlay strip 122 is integral to blanket section 110*b*, formed from a wide stitched hem on the inner edge of blanket section 110*b*.

Overlay strip 121 and/or underlay strip 122 may be material identical to the material of blanket sections 110*a* or 110*b*, or a different material selected for characteristics such as, but not limited to, contrasting color for ease of locating slit 120, increased insulation, or durability. Overlay strip 121 and/or underlay strip 122 may be reinforced by additional layers of material along their entire length or in certain places likely to experience additional stress, such as, but not limited to, a section of overlay strip 121 and/or underlay strip 122 where fasteners 130 are located. However, overlay strip 121 and underlay strip 122 are optional for all versions of blanket 100.

Fasteners 130 may encompass both single fasteners and pairs of complementary fasteners. Fasteners 130 may include, but are not limited to, a T-button and eyehole, a button and buttonhole, a male snap and female receiver, a zipper, a hook-and-loop fastener (e.g., VELCRO®), a hook-and-eye fastener, a pair of magnets, a pair of ties, a cord laced within eyelets, or any other fastener known in the art. Versions utilizing magnet fasteners 130 preferably sew pairs of magnets within opposing inner edges of blanket sections 110*a* and 110*b*. Versions utilizing ties preferably sew pairs of ties between opposing inner edges of blanket sections 110*a* and 110*b*. Versions utilizing cords preferably lace at least one cord through and between eyelets located on opposing inner edges of blanket sections 110*a* and 110*b*. Versions utilizing overlay strip 121 and/or underlay strip 122 may instead locate or attach fasteners 130 or various components of fasteners 130 within or on overlay strip 121 and/or underlay strip 122.

Blanket 100 could also be made with no fasteners 130 so long as slit 120 does not extend down the entire length of blanket 100. If slit 120 is formed down the entire length of blanket 100, the top and bottom of blanket 100 may use fasteners 130 with greater gripping force, and/or a greater number of fasteners 130, so that blanket sections 110*a* and 110*b* can be more firmly bound together at the bottom of blanket 100. Overlay strip 121 and/or underlay strip 122, if used, might then be wider at the bottom of blanket 100.

FIGS. 1 through 3*a* illustrate a particularly preferred version of blanket 100, with FIG. 1 showing exemplary preferred proportions. Slit 120 (and thus the opposing blanket sections 110*a* and 110*b*) is approximately 7 feet long, such that each blanket section 110*a* and 110*b* can substantially cover the entire length of the body of a typical user. As can be seen in FIGS. 2*a* through 3*b*, one blanket section 110*a* or 110*b* has one or more fabric T-buttons 131 attached along its inner edge, with each T-button 131 being receivable in a corresponding eyehole 132 spaced slightly inwardly from the inner edge of the opposite blanket section 110*a* or 110*b*. In this version, T-button 131 is located beneath overlay strip 121 of blanket section 110*a* while eyehole 132 is located on underlay strip 122 of blanket section 110*b*; other contemplated versions may reverse this orientation.

Each T-button 131 is defined by a flexible fabric trunk 131*a* having a base attached to the inner edge of blanket section 110*a*, with trunk 131*a* extending from blanket section 110*a* to terminate in an attached button member 131*b*. Button member 131*b* is formed by an elongated member defining a pair of arms which each extend perpendicularly from trunk 131*a*, and parallel to the inner edge of blanket section 110*a*. Button member 131*b* is preferably formed of several layers of fabric which are sewn or otherwise attached together, or of fabric sewn, fused, or otherwise attached around a resiliently flexible member, so that button member 131*b* has a small degree of rigidity. The resiliently flexible member may be plastic, elastomer, or any other resiliently flexible material. In contrast, trunk 131*a* is preferably formed of one or more layers of fabric which are sewn, fused, or otherwise attached together so that it is flexible, yet durable.

On the opposite blanket section 110*b*, each eyehole 132 is preferably defined by a slot oriented parallel to trunk 131*a*, and perpendicular to button member 131*b*. Button member 131*b* can therefore have one of its arms inserted into a corresponding eyehole 132. Button member 131*b* can then be pulled entirely through eyehole 132, at which point it will resist withdrawal unless or until it is manipulated to extend back through eyehole 132 alongside trunk 131*a*. At the same time, T-buttons 131 are relatively soft and flexible such that their contrast in size, shape, and/or rigidity with the surrounding blanket sections 110*a* and 110*b* is not significantly noticeable to the touch.

Fabric overlay strip 121 is sewn, fused, or otherwise connected along the inner edge of blanket section 110*a* (or whichever section bears T-buttons 131) such that it overlaps the opposing blanket section 110*b* and/or underlay strip 122 when blanket sections 110*a* and 110*b* are buttoned together, thereby helping to cover any gaps that may form between blanket sections 110*a* and 110*b* when blanket 100 is in use. In the preferred version shown in FIGS. 1 through 3*a*, blanket 100 has only a single T-button 131, provided on blanket section 110*a* near the top of blanket 100, with eyehole 132 provided on the other blanket section 110*b* on the opposite side of slit 120. While a single T-button 131 has been found sufficient to retain blanket sections 110*a* and 110*b* together at their tops, such that they effectively create a unitary blanket 100, other versions may include additional T-buttons 131 and eyeholes 132 (or other fasteners 130) along the length of slit 120 if desired.

Despite the foregoing, it is emphasized that blanket 100 could have other dimensions, and other fasteners 130 (or combinations of several types of fasteners 130) could be used. Exemplary preferred dimensions are as follows for cases where blanket 100 is configured with the weight of typical bed sheets (where blanket 100 is to be used as a bed sheet), and where blanket 100 is configured with the weight of a typical blanket (for use by itself or over sheets):

- Full Bed Sheet: approximately 96 inches long by 81 inches wide
- Full Blanket: approximately 90 inches long by 90 inches wide
- Full XL Bed Sheet: approximately 100 inches long by 81 inches wide
- Queen Bed Sheet: approximately 102 inches long by 90 inches wide
- Queen Blanket: approximately 90 inches long by 90 inches wide; or approximately 96 inches long by 102 inches wide
- King Bed Sheets: approximately 102 inches long by 105 inches wide; or approximately 102 inches long by 108 inches wide
- King Blanket: approximately 90 inches long by 108 inches wide
- California King Bed Sheet: approximately 102 inches long by 108 inches wide Blanket 100 may be made of any material used for bed sheets, blankets, comforters, quilts, or other bedding, including cotton (pima, Egyptian, upland, SUPIMA, MICRO COTTON, and/or organic), cotton blends (cotton/rayon, cotton/polyester, cotton/bamboo), flannel, fleece, linen, satin, silk, bamboo, hemp, jute, ramie, rayon, polyester, and any combination of the above. All fabric edges are preferably hemmed by stitching or fusion for durability and appearance.

Blanket 100 can therefore be split by users to a desired extent so that one user can fully cover him/herself with a blanket section if cold, and the other user can fold his/her blanket section down if too warm. A single user can also use blanket 100 in a conventional fashion, or can instead rest between the separated blanket sections 110*a* and 110*b*, with blanket sections 110*a* and 110*b* pulled up over his/her shoulders.

Throughout this document, unless the context requires otherwise, the words "include" and "including" (and variations such as "comprise" and "comprising") will be understood to include the stated element (or group of elements), as well as additional instances of the stated element (or group of elements). For example, if it is stated that a blanket includes first and second blanket sections, it should be understood that the blanket might include additional blanket sections as well. Likewise, if it is stated that a blanket includes a fastener, it should be understood that the blanket includes at least one fastener.

It should also be understood that various terms referring to orientation and position used throughout this document—e.g., "bottom"—are relative terms rather than absolute ones. In other words, it should be understood (for example) that the bottom of the blanket may in fact be situated at the top of a bed, or at a side of a bed, depending on the overall orientation of the blanket. Thus, such terms should be regarded as words of convenience, rather than limiting terms.

Where a measurement or other value is qualified by the term "approximately," "about," or like terms—for example, "approximately 6.5 feet"—this can be regarded as referring to a variation of 10% from the noted value. Thus, "approximately 6.5 feet" can be understood to mean between 5.85 feet and 7.15 feet.

The versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A blanket having an area bounded by opposing top and bottom edges, and by opposing side edges extending between the top and bottom edges, the blanket including:

a. a slit:
  (1) situated inwardly from the side edges of the blanket, and
  (2) extending:
    (a) from the top edge of the blanket toward the blanket's bottom edge, and
    (b) along at least a substantial portion of the blanket's length, and b. a first blanket section separated from a second blanket section by the slit, the blanket sections having inner edges on opposite sides of the slit; and c. one or more fasteners provided on at least one side of the slit, whereby the first and second blanket sections on opposing sides of the slit may be removably attached together by the one or more fasteners at desired locations, each fastener including:
  (1) a T-button on the first blanket section, the T-button having:
    (a) an elongated flexible trunk having a length extending:
      i. from a first trunk end adjacent the inner edge of the first blanket section to an opposing second trunk end, and
      ii. along a plane parallel to a plane in which the first blanket section rests,
    (b) an elongated button member attached to the second trunk end at a location spaced from the opposing ends of the length of the button member, the T-button having a minimum size in a direction oriented perpendicular to a plane defined by the length of the trunk and the length of the button member,
  (2) an eyehole on the second blanket section,
  whereby the button member can be oriented parallel to the trunk and inserted into the eyehole, and then oriented perpendicular to the trunk to deter its withdrawal from the eyehole.

2. The blanket of claim 1, where:

a. the slit extends from the top edge of the blanket to a blanket base bounded by the bottom edge of the blanket, and b. the first and second blanket sections are joined to the blanket base.

3. The blanket of claim 1, where the slit extends from the top edge of the blanket to the bottom edge of the blanket.

4. The blanket of claim 3, where multiple fasteners are provided on at least one side of the slit adjacent at least the top edge of the blanket and the bottom edge of the blanket.

5. The blanket of claim 1, where:

a. an overlay strip is connected along an inner edge of the first blanket section to overlay the second blanket section when the first and second blanket sections are fastened together, and b. the one or more fasteners are situated off the overlay strip.

6. The blanket of claim 5, where an underlay strip is connected along an inner edge of the second blanket section to underlie the overlay strip when the first and second blanket sections are fastened together.

7. The blanket of claim 6, where the one or more fasteners are attached to the underlay strip.

8. The blanket of claim 1 wherein the trunk and button member are both formed of multiple layers of fabric.

9. The blanket of claim 1 where the button member includes a resiliently flexible member with fabric extending thereabout.

10. The blanket of claim 1, where the trunk extends:

a. from the first trunk end adjacent the inner edge of the first blanket section, and b. toward the side edge of the blanket bounding the first blanket section.

11. A blanket including:

a. first and second blanket sections having opposing inner edges with a slit therebetween;

b. a T-button provided on the first blanket section, the T-button having an elongated flexible trunk extending from the first blanket section:
  (1) at least substantially perpendicular to the inner edge of the first blanket section, and
  (2) along a plane parallel to the first blanket section,
  to an elongated button member, the trunk and button member together being shaped like a T; and c. an eyehole provided on the second blanket section, whereby the blanket sections on opposing sides of the slit may be removably attached together by insertion of the T-button within the eyehole.

12. The blanket of claim 11, wherein:

a. the T-button is attached to an inner edge of the first blanket section, and b. the T-button is located beneath an overlay strip attached to the inner edge of the first blanket section.

13. The blanket of claim 11, where the eyehole is located on an underlay strip attached to an inner edge of the second blanket section.

14. The blanket of claim 11, where the button member has a length extending at least substantially parallel to the inner edge of the first blanket section.

15. The blanket of claim 14, where the button member is formed of multiple layers of fabric.

16. The blanket of claim 15, where the trunk is formed of multiple layers of fabric.

17. The blanket of claim 14, where the button member includes a resiliently flexible member with fabric extending thereabout.

18. The blanket of claim 11, where the trunk extends from the first blanket section in a direction away from the second blanket section.

19. A blanket including:

a. first and second blanket sections extending:
   (1) from a blanket base, and
   (2) adjacent each other on opposing sides of a slit, b. a fastener configured to join the first and second blanket sections together across the slit, the fastener including a flexible trunk having a length extending;
   (1) at least substantially perpendicularly from an inner edge of the first blanket section, and
   (2) parallel to a plane in which the first blanket section rests,
   to an attached flexible button member having a length extending at least substantially parallel to the inner edge of the first blanket section.

20. The blanket of claim 19, where the trunk extends from the inner edge of the first blanket section away from the slit.

* * * * *